US011773593B1

(12) United States Patent
Abbas et al.

(10) Patent No.: US 11,773,593 B1
(45) Date of Patent: Oct. 3, 2023

(54) SHEAR BEAM-COLUMN CONNECTION

(71) Applicant: KING SAUD UNIVERSITY, Riyadh (SA)

(72) Inventors: Husain Abbas, Riyadh (SA); Mohammad Alrubaidi, Riyadh (SA); Yousef A. Al-Salloum, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/122,941

(22) Filed: Mar. 17, 2023

(51) Int. Cl.
*E04C 3/06* (2006.01)
*E04C 3/04* (2006.01)

(52) U.S. Cl.
CPC ..... *E04C 3/06* (2013.01); *E04C 2003/0417* (2013.01); *E04C 2003/0452* (2013.01)

(58) Field of Classification Search
CPC ..... E04C 3/06; E04C 2003/0417; E04C 2003/0452
See application file for complete search history.

(56) References Cited

U.S. PATENT DOCUMENTS 368,019 A * 8/1887 Sims ..... E04B 1/2604 52/838
3,140,764 A * 7/1964 Cheskin ..... E04C 3/10 52/645
3,341,995 A * 9/1967 Docken ..... E04C 3/18 52/223.13
4,015,396 A * 4/1977 Butts ..... E04C 3/09 52/840
5,313,749 A * 5/1994 Conner ..... E04C 3/10 52/223.13
5,363,625 A * 11/1994 Philippi ..... F16B 7/187 403/252
5,595,040 A 1/1997 Chen
5,827,006 A 10/1998 Hoshino
6,073,405 A 6/2000 Kasai et al.
6,516,583 B1 2/2003 Houghton
6,754,992 B1 6/2004 Byfield et al.
6,837,016 B2 1/2005 Simmons et al.
7,497,054 B2 3/2009 Takeuchi et al.
8,205,408 B2 6/2012 Gallart et al.
9,765,521 B1 9/2017 Abbas et al.
10,415,230 B1 9/2019 Abbas et al.
10,815,655 B2 * 10/2020 Febbo ..... E04B 1/2604
(Continued)

FOREIGN PATENT DOCUMENTS

CN 209837295 U 12/2019

*Primary Examiner* — Rodney Mintz
(74) *Attorney, Agent, or Firm* — Nath, Goldberg & Meyer; Richard C. Litman

(57) ABSTRACT

A shear beam-column connection includes a first beam, a first tapered bolt having a non-threaded portion and a threaded end portion, and a column including a first wedge slot block. The non-threaded portion of the first tapered bolt is fixedly secured, e.g., by welding, to the first beam. The wedge slot block includes a cavity for removably receiving the non-threaded portion of the first tapered bolt. The first wedge slot block is fixedly secured to the column, e.g., by welding. The first beam can be secured to the column by positioning the first beam adjacent the column such that the non-threaded portion of the bolt is inserted into the cavity. A nut can be threaded to the free end of the bolt to further secure the beam to the column.

11 Claims, 13 Drawing Sheets

(56) References Cited

U.S. PATENT DOCUMENTS

| | | | | |
|---|---|---|---|---|
| 2003/0041549 | A1* | 3/2003 | Simmons | E04B 1/2403 52/655.1 |
| 2004/0244330 | A1* | 12/2004 | Takeuchi | E04H 9/024 52/831 |
| 2010/0043338 | A1* | 2/2010 | Houghton | E04B 1/24 52/745.19 |
| 2019/0010690 | A1 | 1/2019 | Febbo | |

* cited by examiner

SHEAR BEAM-COLUMN CONNECTION

BACKGROUND

1. Field

The disclosure of the present patent application relates to shear beam-column connections, and particularly, to a shear beam-column connection configured to resist progressive collapse.

2. Description of the Related Art

Although reinforced concrete is conventionally employed in building construction, steel is increasingly used as an alternative due to its speed of construction and flexibility. Structural designers are increasingly concerned with performance of conventional steel frame structures under extreme load events due to inconsistent behavior of beam-column connections. Extreme load cases—such as blast loads, vehicle crashes, and earthquakes—can cause failure of column(s) that may lead to "progressive collapse" of the steel framed buildings, i.e., the propagation of an initial local failure from one part to the adjoining parts leading to the collapse of the entire building or a large part of it. While steel is ductile, allowing for large deformation before failure, the response of steel frames to extreme loads is mainly governed by the connections between beams and columns. Existing beam-column connections in steel and reinforced concrete framed buildings can render buildings susceptible to progressive collapse. Conventional shear beam-column connections offer negligible resistance against progressive collapse.

A shear beam-column connection for reducing onsite fabrication time and providing resistance against progressive collapse is desired.

SUMMARY

The shear beam-column connection includes a first beam, a first tapered bolt having a non-threaded portion and a threaded end portion, and a first wedge slot block connected to a column. The non-threaded portion is fixedly secured, e.g., by welding, to the first beam. The wedge slot block includes a cavity for removably receiving the non-threaded portion of the first tapered bolt. The first wedge slot block can be fixedly secured to the column, e.g., by welding. The first beam can be secured to the column by positioning the first beam adjacent the column such that the non-threaded portion of the bolt is inserted into the cavity of the first wedge slot block. A nut can be threaded to the free end of the bolt to further secure the beam to the column.

The shear beam-column connection of the present subject matter offers considerable resistance to progressive collapse by simple tightening of a nut at any time during the service life of the building (or structure). In particular, the present shear beam-column connection has improved rotational capacity compared to conventional beam-column connections. Moreover, welding of the tapered bolt to the web beam and the wedge slot block to the column flange may be done before onsite assembly of the shear beam-column connection, i.e., in a factory/workshop before onsite assembly, simplifying conventional construction of steel frames by eliminating onsite bolting and welding.

These and other features of the present disclosure will become readily apparent upon further review of the following specification and drawings.

BRIEF DESCRIPTION OF THE DRAWINGS

FIGS. 12A-12B show cross-sectional views of embodiments of the shear beam-column connection for: (FIG. 12A) vertical load; and (FIG. 12B) vertical load and moment arising during beam end rotation.

(FIG. 16B) detailed view of the failure of the exterior shear beam-column connection; and (FIG. 16C) detailed view of the failure of the interior shear beam-column connection at the failed column.

Similar reference characters denote corresponding features consistently throughout the attached drawings.

DETAILED DESCRIPTION OF THE PREFERRED EMBODIMENTS

Figure 2:
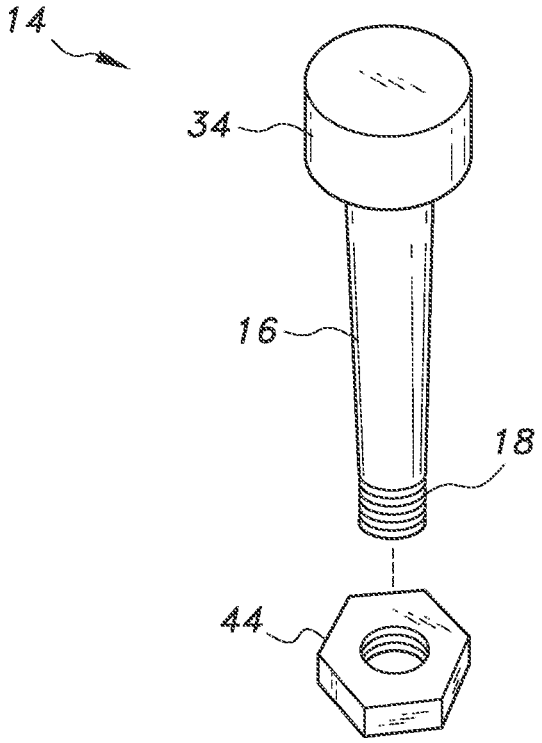
FIG. 2 shows a perspective view of the tapered bolt before welding to the beam web and the nut.
Figure 3:
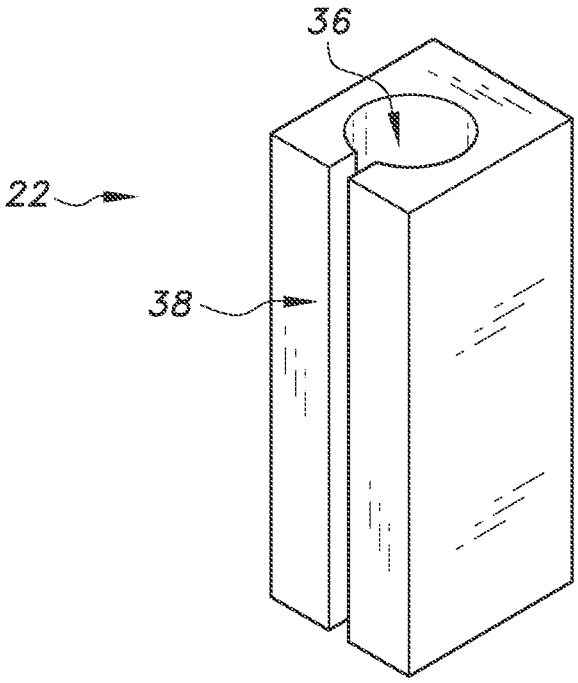
FIG. 3 shows a perspective view of the wedge slot block before welding to the column flange, and the wedge slot capable of accepting the tapered bolt of FIG. 2.
Figure 4:
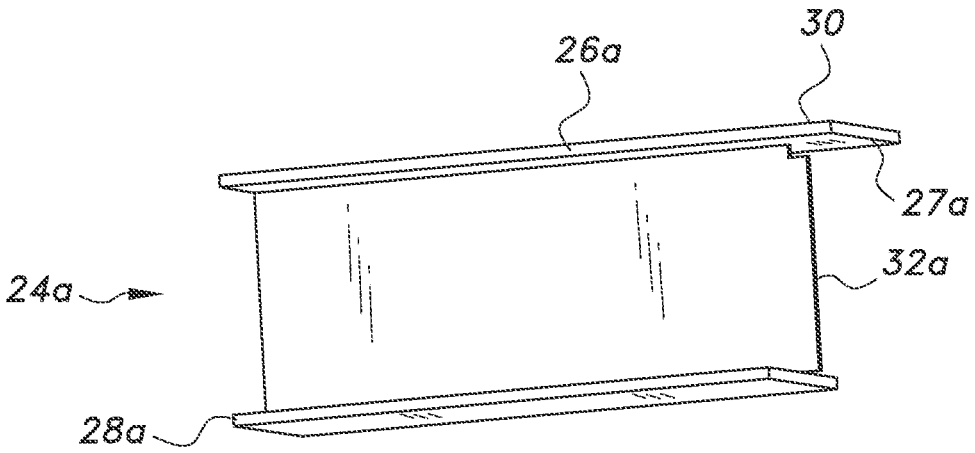
FIG. 4 shows a perspective (top) and side perspective view (bottom) of the beam of the embodiment of FIG. 1, showing the overhanging portion of upper beam flange and the ledge portion of beam web.
Figure 5:
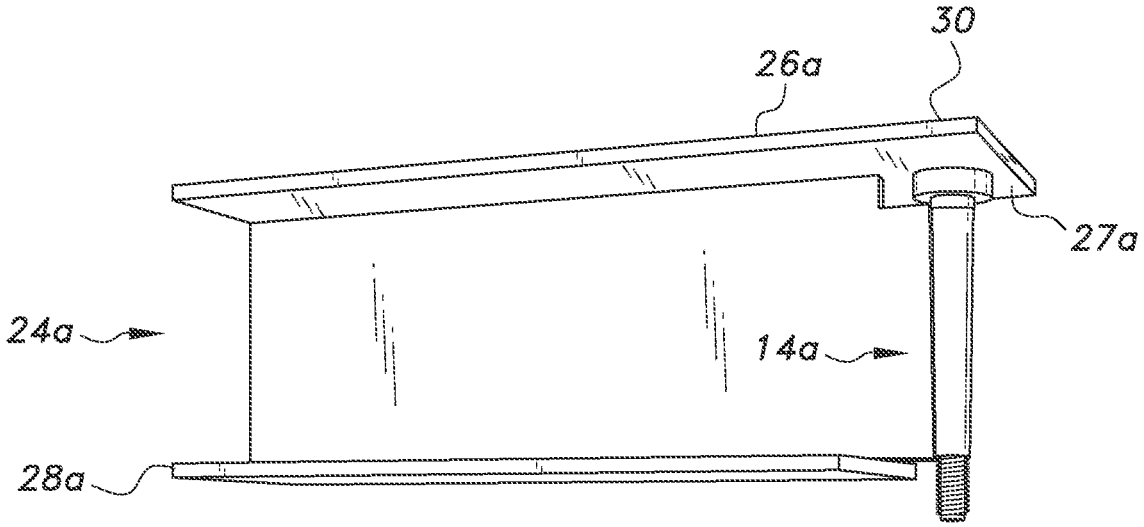
FIG. 5 shows a perspective view of the tapered bolt of FIG. 2 welded to the ledge portion of beam web of FIG. 4.
Figure 6:
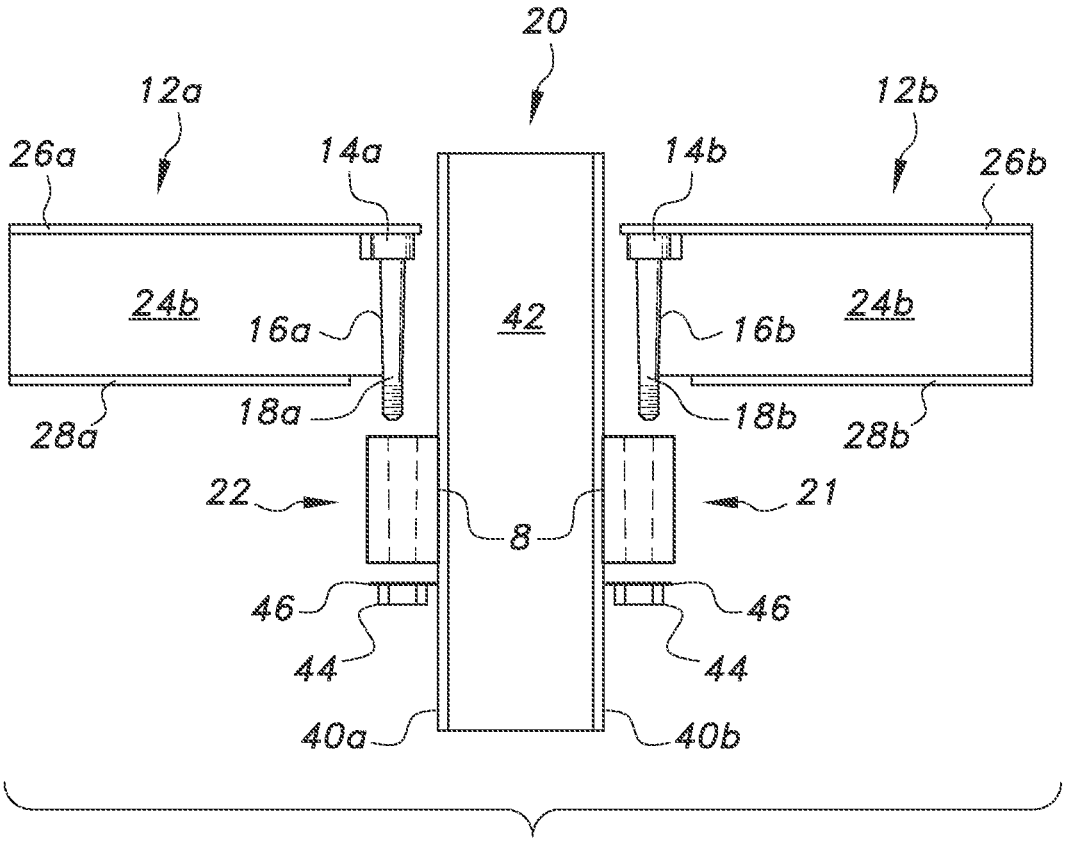
FIG. 6 shows a front elevation view of an embodiment of the shear beam-column connection before assembly.
Figure 7:
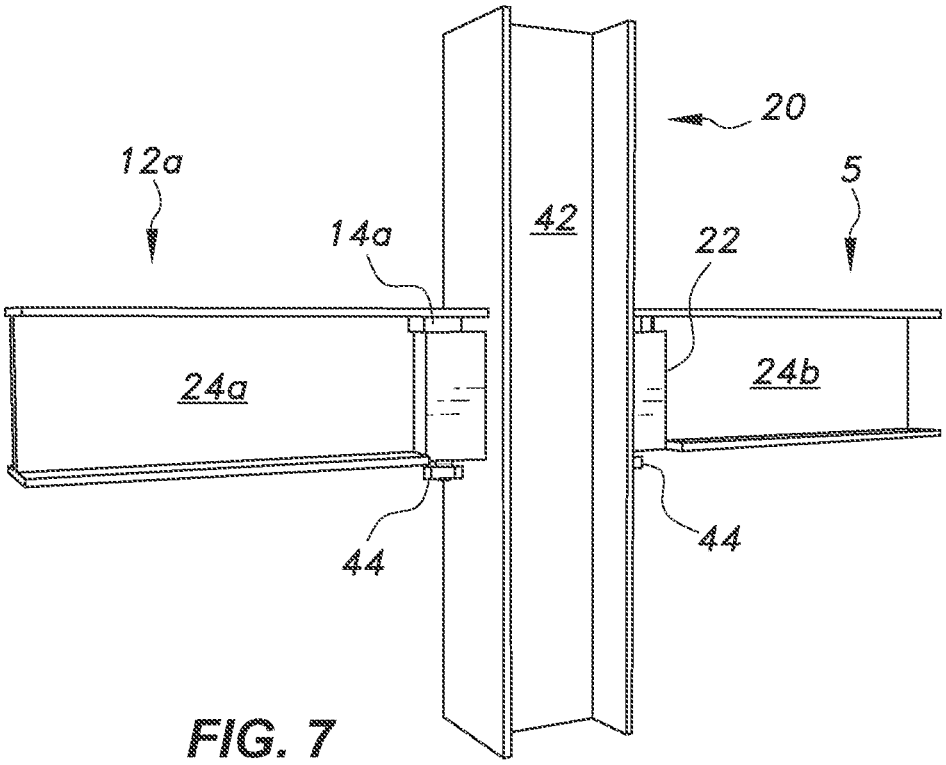
FIG. 7 shows a longitudinal cross-section of the assembled shear beam-column connection.
Figure 8:
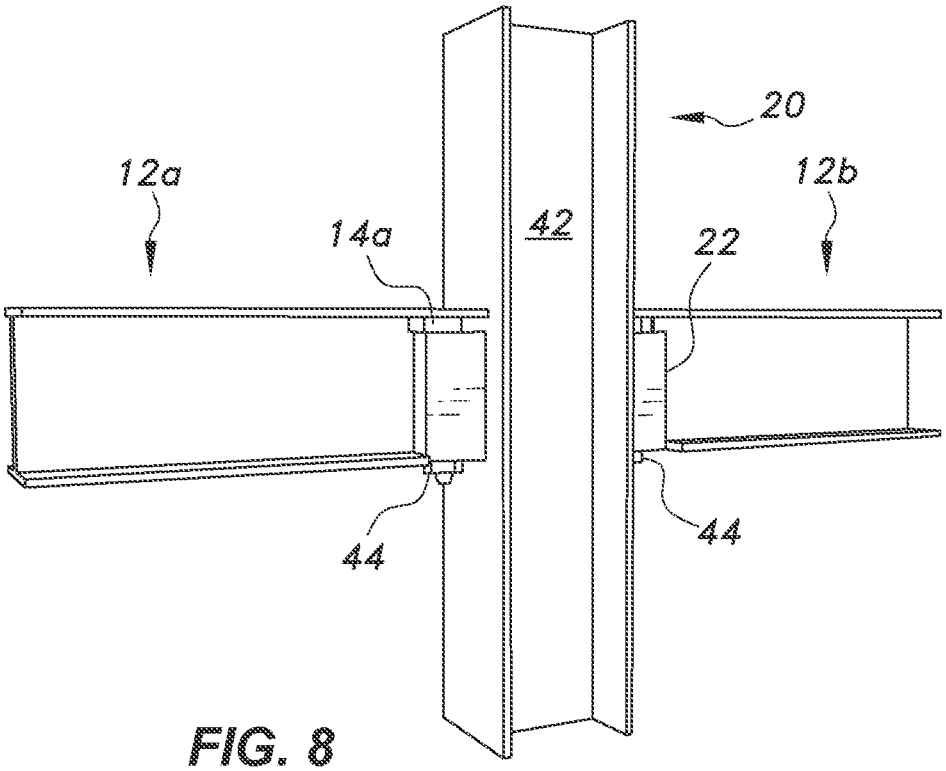
FIG. 8 shows a perspective view of an embodiment of the shear beam-column connection, assembled.

As shown in FIGS. 1-8, a shear beam-column connection 10 includes a first beam 12*a*, a first tapered bolt 14*a* having a non-threaded shank portion 16*a* and a threaded shank end portion 18*a*, and a column 20 including a first wedge slot block 22. The first beam 12*a* can have a generally rectangular web 24*a*, an upper beam flange 26*a* extending normal to a portion of a top edge the web 24*a*, and a lower beam flange 28*a* extending normal to a portion of the bottom edge of the web 24*a*. A remaining portion of the top edge of the web 24*a* can be spaced from the upper beam flange 26*a* and a remaining portion of the bottom edge of the web 24*a* can extend beyond an edge of the lower beam flange 28*a*, thereby defining a ledge portion 32*a*. As shown in FIGS. 4-5, one end of the upper beam flange 26*a* defines an overhang 30 that extends beyond an edge of the lower beam flange 28*a* and the web 24*a*. The first tapered bolt 14*a* can have a bolt head 34 secured to a lower surface 27*a* of the overhang portion of the upper beam flange 26*a*. The non-threaded shank portion 16 can be fixedly secured to the ledge portion 32*a* of the web 24*a* by, e.g., a weld.

As shown in FIG. 3, the first wedge slot block 22 can include a cavity 36 defined therethrough configured to receive the non-threaded shank portion 16*a*, and a slot 38 extending along a side of the block 22. The slot 38 can be contiguous with the cavity 36 and configured to receive the ledge portion 32*a*.

Figure 1:
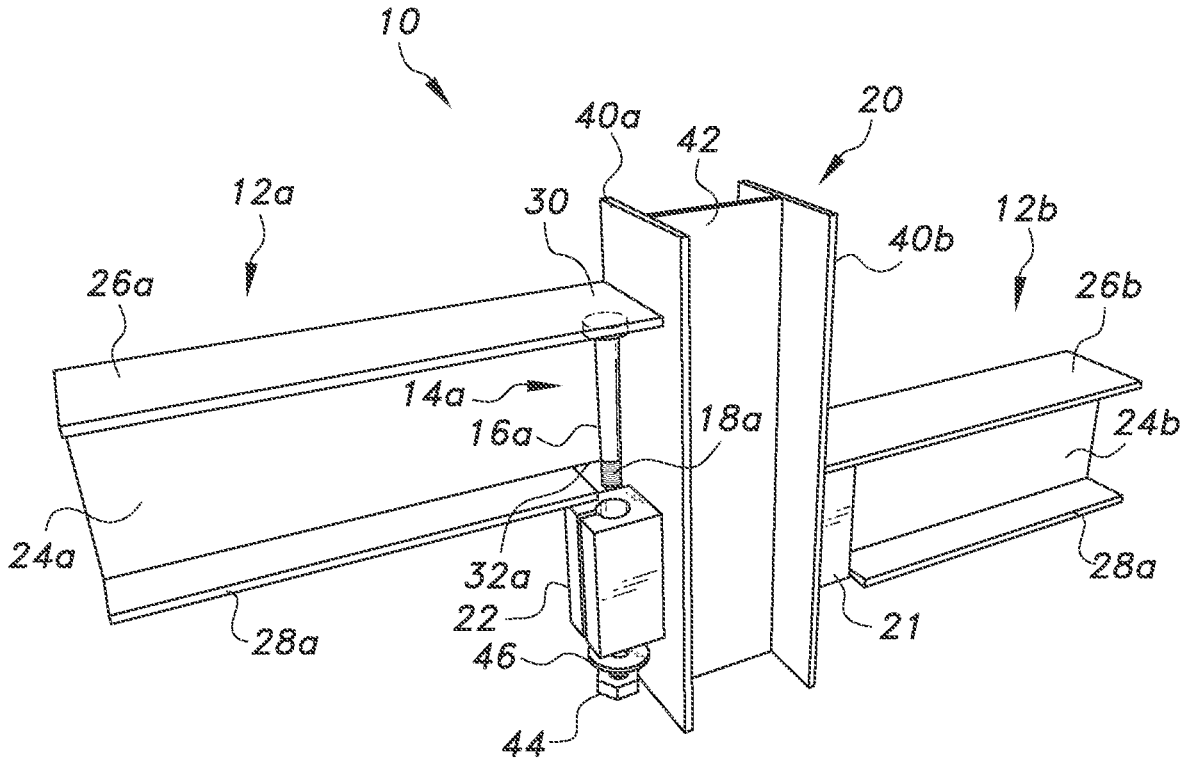
FIG. 1 shows a perspective view of the shear beam-column connection; the beam on the left is being lowered for connecting with the column, whereas the beam on the right side is in a connected position.

The column 20 can have a first column flange 40*a*, a second column flange 40*b*, and a column web 42 extending between the first column flange 40*a* and the second column flange 40*b*. The first column flange 40*a* and the second column flange 40*b* can extend normal to the column web 42. The first wedge slot block 22 can be fixedly secured to the first column flange 40*a*. In an embodiment, the shear beam-column connection can include a second beam 12*b* and a second wedge slot block 21 (FIG. 1). The second wedge slot block 21 can be fixedly secured to the second column flange 40*b* for receiving a second tapered bolt 14*b* of the second beam 12*b*. The second beam 12*b* can be identical to the first beam 12*a*. A nut 44 can be threaded to the free end of each bolt to further secure each beam to the column 20. In an embodiment, a washer 46 may be used for proper tightening of the nut 44.

In an embodiment, the shear beam-column connection 10 may further comprise one or more stiffeners 50, as shown in FIGS. 14A-14D. Each of said one or more stiffeners 50 can have a first side welded to the wedge slot block 22, and a second side welded to column flange. In an embodiment, the one or more stiffeners 50 can include a plurality of stiffeners 50 and the plurality of stiffeners 50 can be arranged on opposing sides of the wedge slot block 22. The stiffeners 50 may be of different shapes such as rectangular, triangular, trapezoidal, polygonal or with a curved side. The tapered bolt 14*a* can include threads 18*a* at an end of the shank that is opposite from the bolt head for tightening a nut 44, which adds resistance against progressive collapse under extreme load scenarios. The tapered bolt 14 may have an elliptical cross-section and, in a particular embodiment, may have a circular cross-section.

The first beam 12*a* can be secured to the column 20 by positioning the first beam 12*a* adjacent the column 20 such that the non-threaded portion 16 of the bolt 14 is inserted into the cavity 36. A nut 44 can be threaded to the free end 18 of the bolt 14 to further secure beam 12*a* to the column 20. FIG. 1 shows a first beam 12*a* on the left side of the column 20 being lowered for connecting with the column 20, and a second beam 12*b* on the right side of the column 20 in a final connected position.

The shank 16*a* of the tapered bolt 14*a* can be tapered. An area of a cross-section of the shank 16*a* parallel to a plane at which the shank 16*a* meets the bolt head 34*a* decreases monotonically from a maximum at the plane at which the shank 16*a* meets the bolt head 34*a* to a minimum at a plane at which the shank 16*a* meets the thread 18*a*, as shown in FIG. 2. The thread 18*a* is only at an end portion for tightening a nut 44 thereto under the wedge slot block 22. The taper angle can be small. In an embodiment, the taper angle may be greater than 0° and less than or equal to 5°. The bolt head 34 transfers load to the wedge slot block 22, shown in FIG. 3. As the bolt head 34 is not meant for tightening, the shape of the bolt head 34 is not particularly limited and may be circular or square. In other embodiments, the bolt head 34 may be polygonal, such as octahedral or hexahedral. In a particular embodiment, the shank of the tapered bolt 14 is radially symmetric (i.e., has a circular cross-section).

The internal cavity of the wedge slot block 22 is configured to receive the shank 16 of the tapered bolt 14. In a particular embodiment, the cavity 36 of the wedge slot block 22 is geometrically similar to the shank of the tapered bolt 14, but the diameter of the tapered bolt 14 at a widest part of the shank 16 is slightly smaller than a widest portion of the diameter of the cavity 36. The bolt head 34 can be in contact with the top of the wedge slot block 22, thereby transferring the load from the beam to the wedge slot block 22 through the bolt head 34 when the shear beam-column connection is in the connected position. This configuration can avoid contact between the shank of the tapered bolt and the cavity in the wedge slot block (FIG. 7) and hence avoid radial expansion forces on the wedge slot block 22, thereby enhancing the rotation capacity of the joint. The taper becomes effective when the bolt head fails in shear. The thickness or width of the bolt head is not particularly limited. The threaded portion of the tapered bolt 14*a* can be cylindrical.

The wedge slot block 22 can be made from steel or other suitable material. The wedge slot block 22 can be a cuboid structure with the cavity 36 defined therethrough and the slot contiguous with the cavity 36 and extending along a side thereof (FIG. 3). The shape of the cavity 36 can match the shape of the shank 16 of the tapered bolt 14. In the embodiment in which the shank 16 has a circular cross-section, for example, the cavity 36 can have a shape substantially of an inverted conical frustum. A back surface of the wedge slot block 22 i.e., the surface opposite to the surface with the slot 38, can be welded to the column flange. The weld can be strong enough to resist shear and bending moments arising due to rotation of the beam end. The welded connection of the wedge slot block can be capable of resisting forces arising during progressive collapse.

As shown in FIG. 4, the web of the first beam 12*a* can have a shank end suitable for forming a weld with the shank of the tapered bolt, e.g., the shank end can be tapered to match the taper in the shank of the tapered bolt. The lower flange 28*a* can have a length that is shorter than the upper flange 26*a* and spaced from the shank. The upper flange 26*a* includes an overhang portion that extends beyond the lower flange 28*a*.

In an embodiment, the tapered bolt 14 may be welded to the shank end of the web, as shown in FIG. 5. The shear strength of the weld can be greater than the shear strength of the beam web. In a further embodiment, the bolt head is welded to the upper flange 26*a*.

In the case of an internal connection, a first wedge slot block 22 can be welded to one column flange and a second wedge slot block can be welded to a corresponding position on the opposite column flange. The beam 12*a* can be lowered (FIG. 1, left side before lowering, right side after lowering; and FIGS. 6-8) such that the tapered bolt 14 gets inserted into the cavity of the wedge slot block 22. The nut 44 can be tightened onto the thread 18 of the tapered bolt 14 for providing resistance against progressive collapse. Thus, the tightening may be done at any time during the service life of the building comprising said connection, saving fabrication time of the frame.

Figure 9:
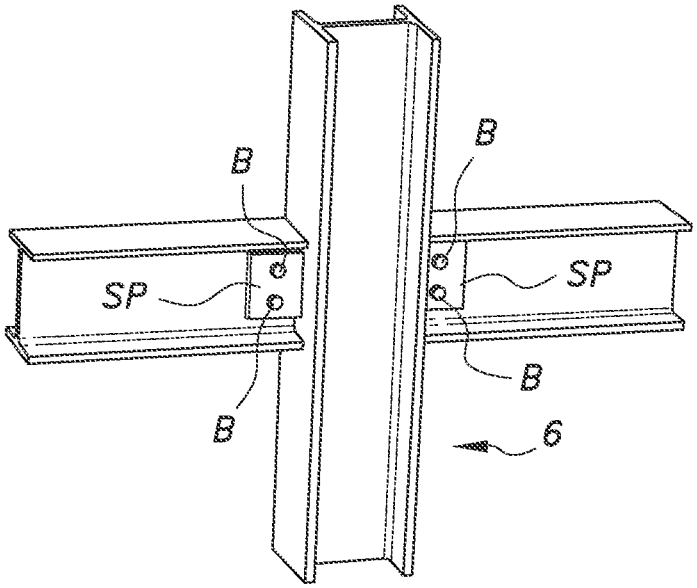
PRIOR ART FIG. 9
FIG. 9 shows a perspective view of a shear beam-column interior connection according to the prior art (B: Bolt, SP: Shear Plate).
Figure 10:
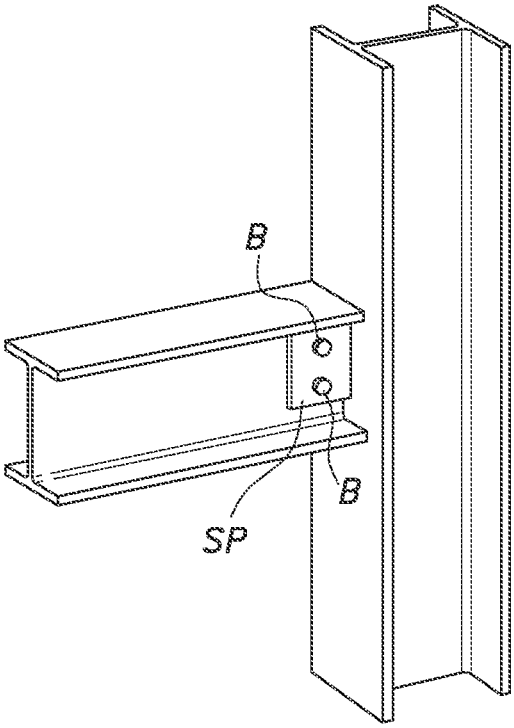
PRIOR ART FIG. 10
FIG. 10 shows a perspective view of a shear beam-column exterior connection according to the prior art (B: Bolt, SP: Shear Plate).

The shear beam-column connection 10 does not require any onsite bolting, which is required in conventional shear beam-column connections, as shown in FIGS. 9 and 10.

Figure 11A:
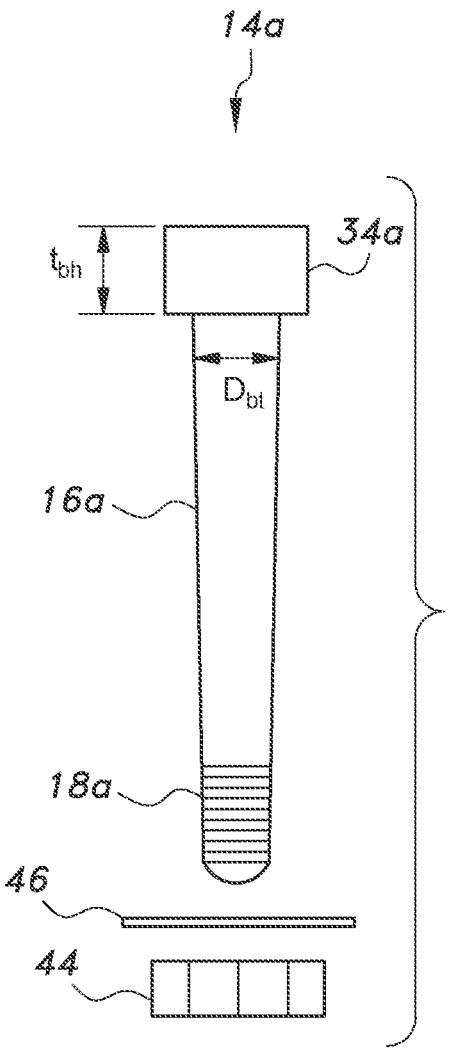
FIG. 11A shows a side view of the tapered bolt.
Figure 11B:
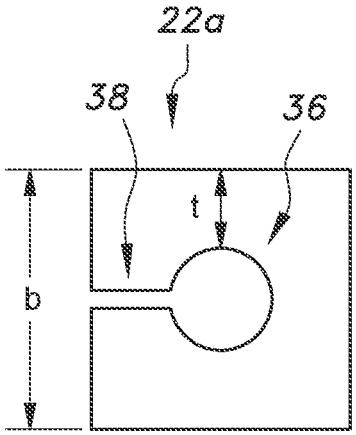
FIGS. 11B-11C show top and side views of the wedge slot block, respectively, with dimensions indicated.
Figure 11C:
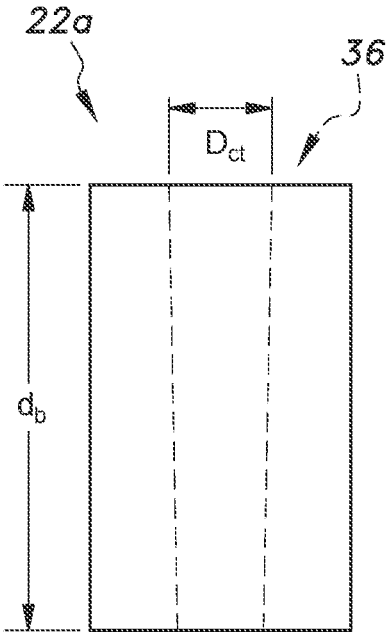
Figure 12A:
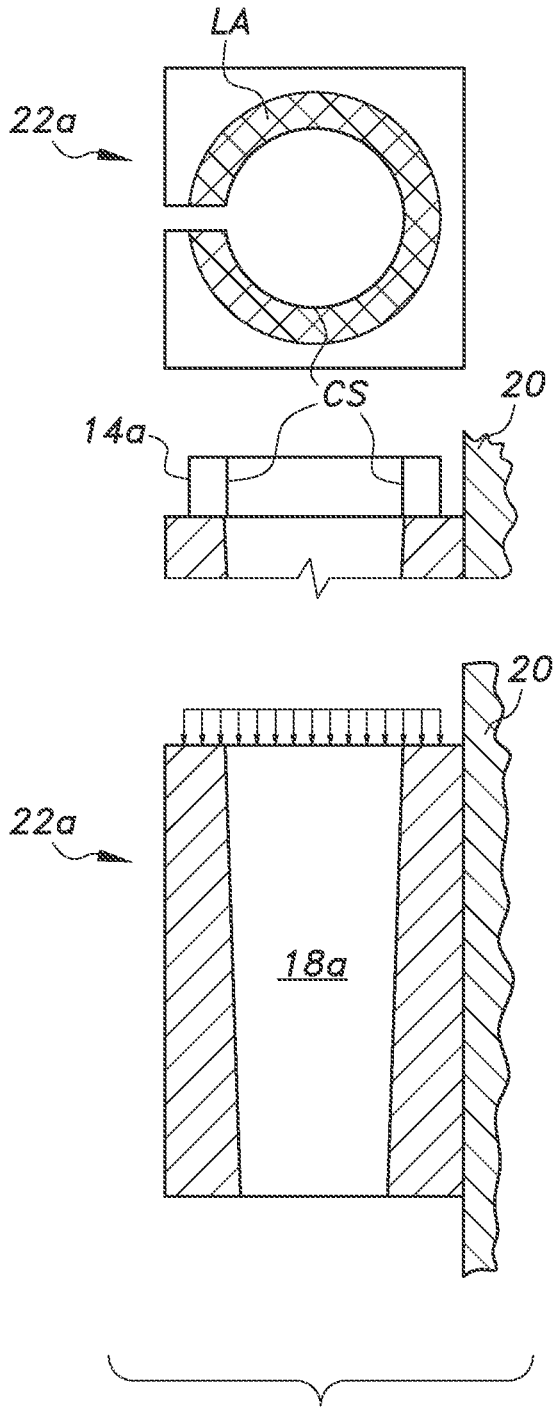
Figure 12B:
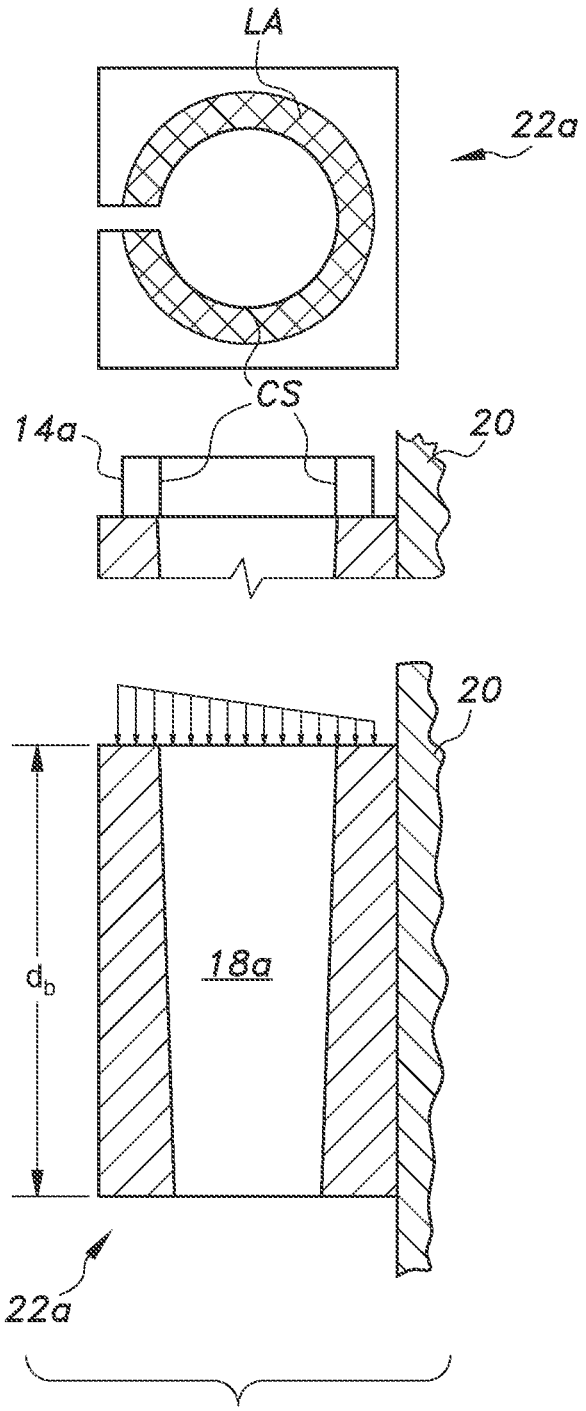

For theoretical analysis, an embodiment of the tapered bolt with a circular cross-section was considered. Dimensions of the tapered bolt 14 and the wedge slot block 22 in this embodiment are shown in FIG. 11. The diameter of the cavity 36 in the wedge slot block 22 at the top ($D_{ct}$) of the wedge slot block 22 is slightly greater than the diameter of the tapered bolt shank 16 at the top ($D_{bt}$), and the taper of both the cavity 36 and the shank 16 are equal, so that the transfer of vertical load is only through the contact between the bolt head 34 and the top surface of the wedge slot block 22 (FIGS. 12A-12B). This may cause shearing of the bolt head 34. Thus, a shear strength of bolt head 34 can be greater than or equal to a shear strength of the beam web, i.e.;

$$\frac{\pi}{4}D_{bt}^2 t_{bh} f_{sb} \geq d_w t_w f_y \tag{1}$$

where, $t_{bh}$ is a thickness of the bolt head (FIG. 11), $f_y$ is a yield stress of the steel of beam, $t_w$ and $d_w$ are a thickness and a depth of the web of the beam, and $f_{sb}$ is a shear strength of the bolt head. In the present shear beam-column connection, transfer of load from beam to the column through the contact between the shank 16 and the cavity 36 of the wedge slot block 22 provides additional resilience to failure of the frame or the connection. This transfer of load comes into effect after shear failure of the bolt head 34 or during progressive collapse failure. In the absence of a taper in a shank 16, the failure of the bolt head 34 can lead to total collapse (the non-tapered bolt without the bolt head can fall through the wedge slot block). Moreover, if the diameter of the cavity 36 in the wedge slot block 22 at the top ($D_{ct}$) of the wedge slot block 22 is equal or smaller than the diameter of the tapered bolt shank 16 at the top ($D_{bt}$), the transfer of vertical load will be through contact between the tapered bolt shank 16 and the cavity of the wedge slot block 22.

The size of the weld between the wedge slot block 22 and column flange can be such that it is able to transfer the shear force from the beam to the column safely.

Figure 13A:
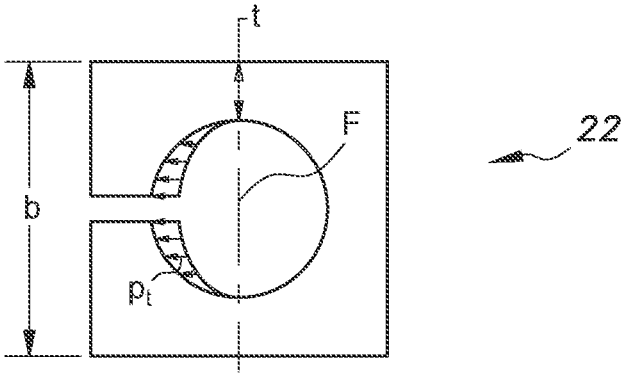
FIGS. 13A-13C show how pressure is exerted by the tapered bolt on the wedge slot block due to beam end rotation, viewed from a top view (top) (FIG. 13A), a longitudinal cross-section (middle) (FIG. 13B), and a bottom view (bottom) (FIG. 13C).
Figure 13B:
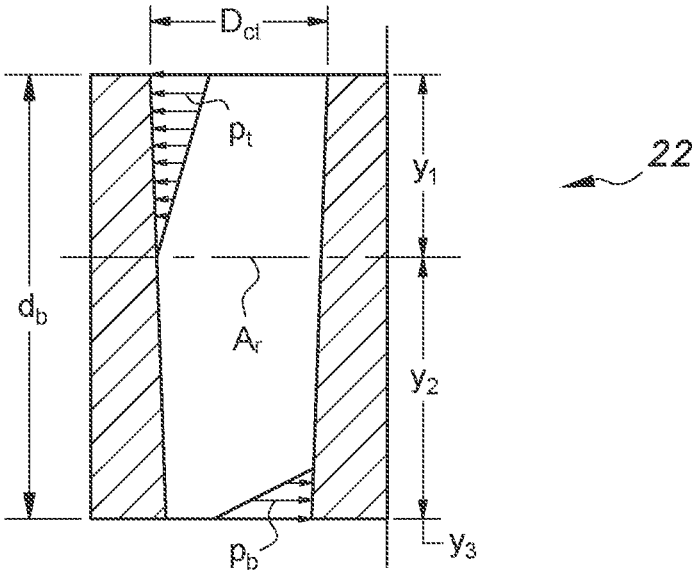
Figure 13C:
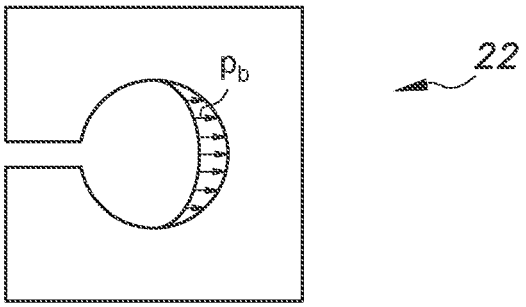

Rotation of the beam end due to load on the beam can cause rotation of the tapered bolt. By such rotation, a top portion of the tapered bolt shank 16 pushes a top portion of the slot of the wedge slot block 22 (depth $y_1$) and a bottom portion of the tapered bolt shank 16 pushes a bottom portion of the wedge slot block towards the column 20 (depth $y_3$), as shown in FIGS. 13A-13C. This leads to a no contact zone (depth $y_2$) between the tapered bolt shank 16 and the inside tapered surface of the wedge slot block (FIG. 13B). The upper portion of the slot 38 of the wedge slot block 22 (FIG. 13A), being pushed by the tapered bolt 14, is relatively flexible (FIG. 13C) due to the slot in the wedge slot block for the beam web), as compared to the lower portion of the wedge slot block 22 being pushed by the tapered bolt 14. Thus, the depth $y_3$ is much smaller than $y_1$, which may be ignored for simplifying the analysis. The moment caused by these forces can be calculated approximately using:

$$M_f = \frac{1}{8}p_t y_1 D_{bt}(2d_b - y_1) \tag{2}$$

where $p_t$ is a peak pressure applied by the tapered bolt at the top of the wedge slot block, and $d_b$ is the depth of the wedge slot block. As the connection is primarily meant for the transfer of shear, the moment that can be resisted by the connection is small. The rotation capacity of the connection will be based on the moment of resistance of the critical section of the upper portion of the wedge slot block (FIG. 13A). The moment caused by these forces at the critical section can be calculated approximately using:

$$M_{fc} = \frac{1}{16}p_t y_1 D_{bt}(D_{bt} + t) \tag{3}$$

where $$t\left(= \frac{1}{2}(b - D_{bt})\right)$$

is a thickness of a critical section of the wedge slot block (FIG. 13A). The moment of resistance of the critical section is given by:

$$M_r = \frac{1}{6}y_1 t^2 f_{bb} \tag{4}$$

where $f_{bb}$ is an allowable bending stress of the wedge slot block. Equating the bending moment at the critical section, given by Eq. (3), to the moment of resistance of the critical section, given by Eq. (4), results in:

$$p_t = \frac{8t^2 f_{bb}}{3D_{bt}(D_{bt} + t)} \tag{5}$$

The value of $y_1$ will depend upon the deformation of the wedge slot block 22 and cavity 36, which will depend on the size of the wedge slot block 22. In an embodiment, $y_1$ can vary from 30% to 40% of the depth of the wedge slot block. Given the values of $p_t$ and $y_1$, the moment of resistance of the joint can be calculated using Eq. (2). The upper bound for the moment of resistance of the joint will be equal to the moment of resistance of the beam, $M_{bw}$, which can be calculated using:

$$M_{bw} = \frac{1}{6} t_w d_w^2 f_{bs} \quad (6)$$

where $f_{bs}$ is an allowable bending stress of the beam. The present connection is a shear beam-column connection because the connection between the beam and the column is only through the beam web, which mainly resists shear. This is why the moment of resistance of the present shear beam-column connection is low, as its upper bound is equal to the moment of resistance of the beam web, given by Eq. (6).

Figure 14A:
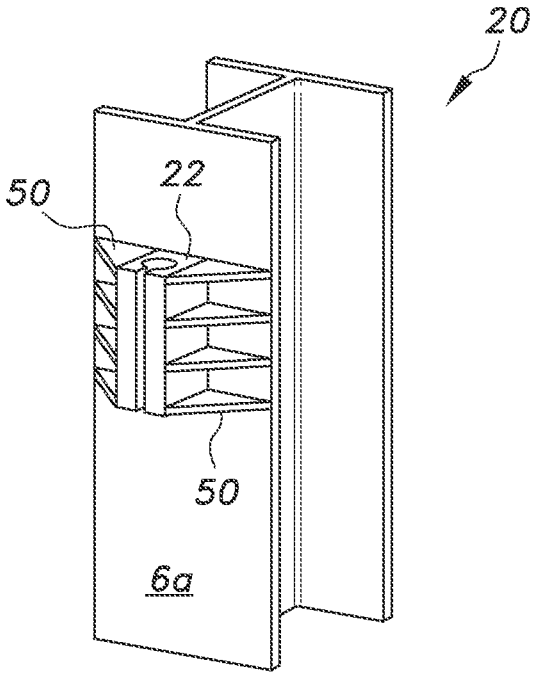
FIGS. 14A-14D show perspective views of a wedge slot block welded to a column flange according to embodiments of the present shear beam-column connection which includes (FIG. 14A) triangular stiffeners at regular spacing; (14B) rectangular stiffeners at regular spacing; (14C) triangular stiffeners at close spacing near the top and the bottom; and (14D) rectangular stiffeners at close spacing near the top and the bottom.
Figure 14B:
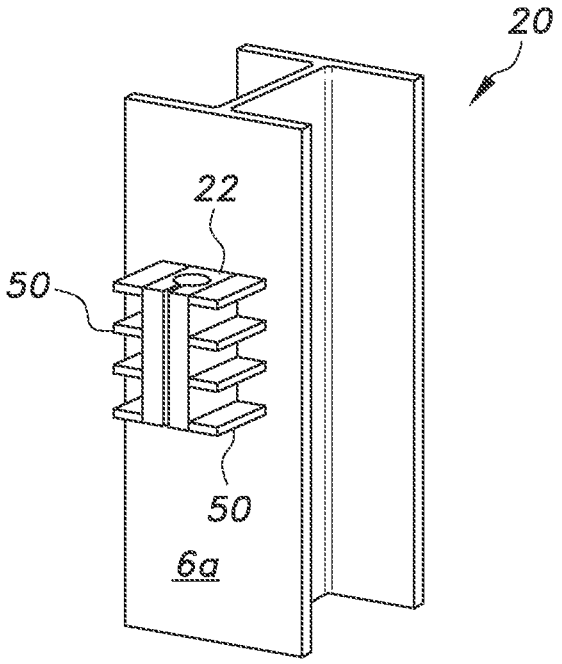
Figure 14C:
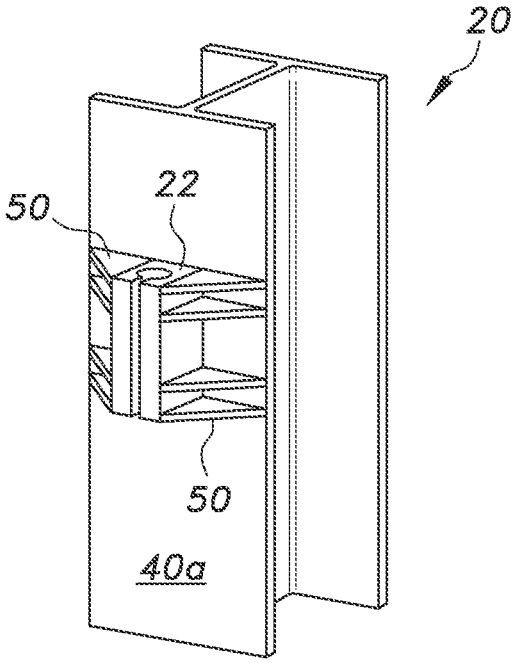
Figure 14D:
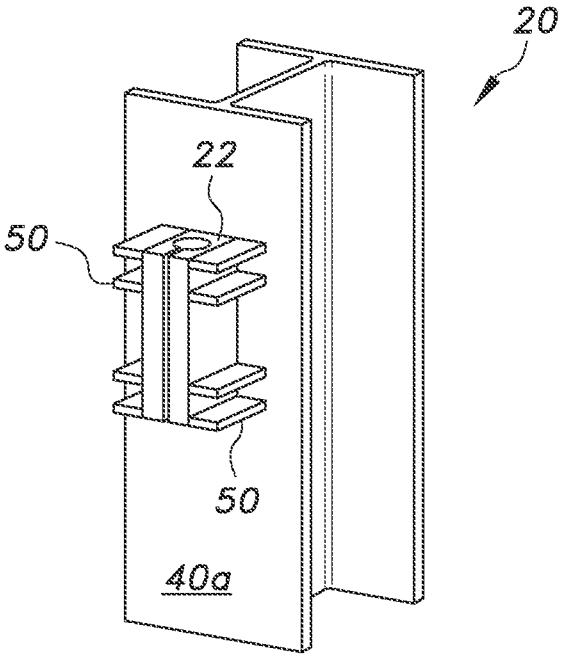

The size of the wedge slot block 22 can be optimized by using strengtheners or stiffeners 50 of different shapes and layout, as shown in FIGS. 14A-14D. Although two shapes of stiffeners are shown, i.e., rectangular and triangular, other shapes, such as trapezoidal or other polygonal shapes with straight or curved side may be used. The rectangular stiffeners 50 (FIGS. 14B, 14D)) can be more effective at stiffening the wedge slot block than the triangular stiffeners 50 (FIGS. 14A, 14C). The use of stiffeners 50 reduces the requirement of a thickness of the critical section, t (FIG. 13A). Upper stiffeners 50 resist negative moment (i.e., hogging moment), whereas lower stiffeners 50 resist positive moment (i.e., sagging moment). The sagging moment may arise either during action of lateral loads (due to wind or earthquake loads) or progressive collapse. Since the chance of occurrence of the positive moment are low, the number of stiffeners in the lower portion can be reduced by providing at least one stiffener at the bottom. However, to keep the same level of resistance for negative and positive moments, a same number of stiffeners may also be provided in the upper and lower portions of the wedge slot block. The spacing of stiffeners 50 in the upper and the lower portions can be reduced (FIGS. 14C, 14D)) for more effectively resisting the opening of the upper and lower portions of the wedge slot block under the action of negative and positive moments, respectively. The number of stiffeners 50 may also be varied depending upon desired additional resistance.

Figure 15A:
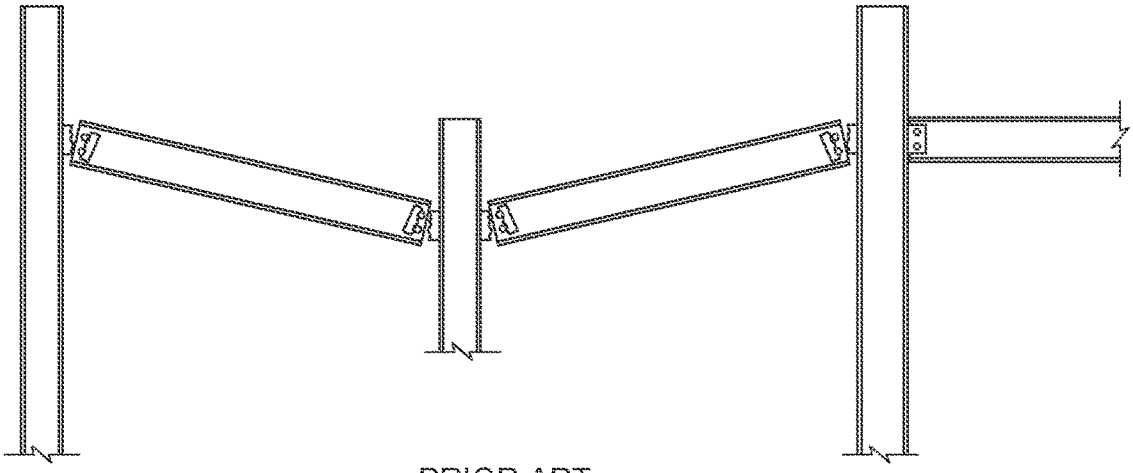
PRIOR ART FIG. 15A
FIGS. 15A-15C shows a front elevation view of beams and columns connected by conventional shear beam-column connections during (15A) failure of the frame due to the failure of the internal column; (15B) detailed view of the failure of the exterior shear beam-column connection; and (15C) detailed view of the failure of the interior shear beam-column connection at the failed column.
Figure 15B:
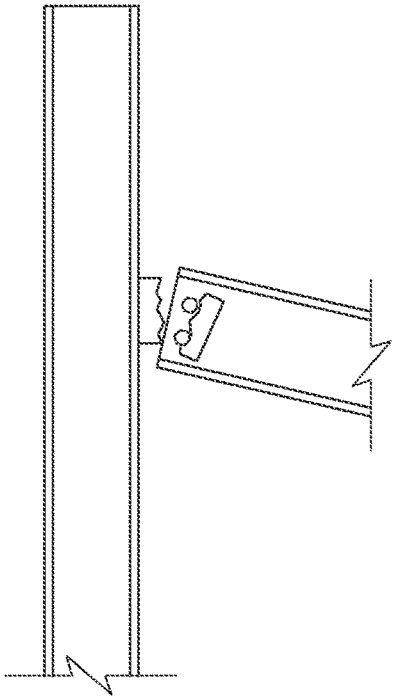
PRIOR ART FIG. 15B
Figure 15C:
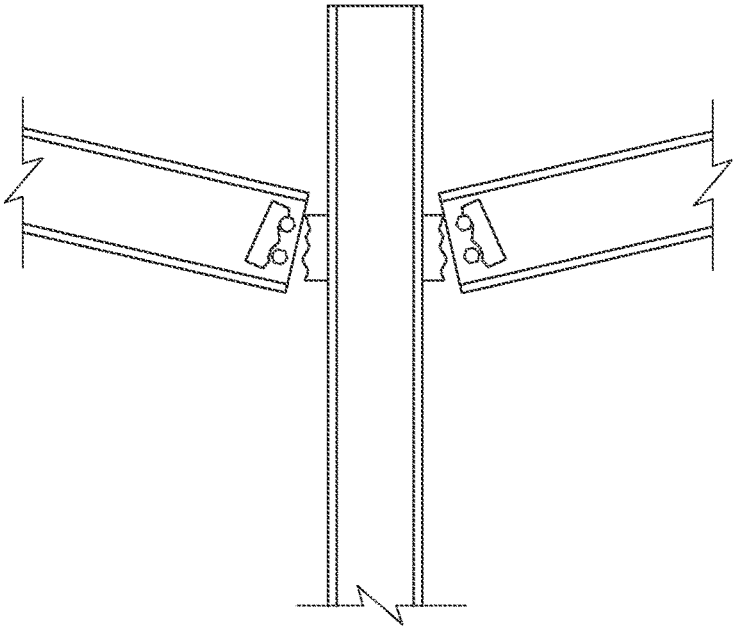
PRIOR ART FIG. 15C
Figure 16A:
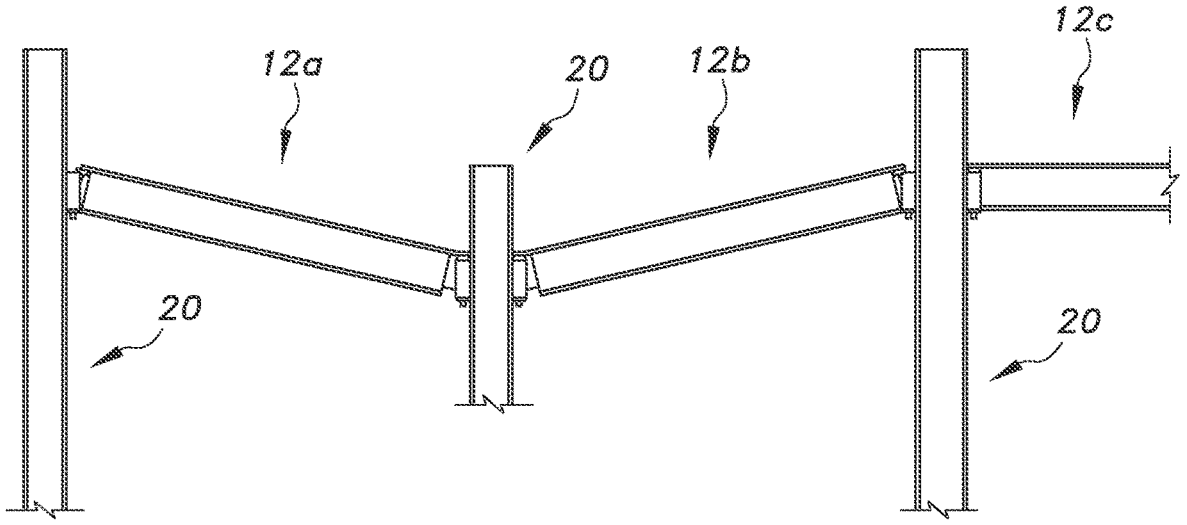
FIGS. 16A-16C show a front elevation view of beams and columns connected by the present shear beam-column connections according to an embodiment without stiffeners during (FIG. 16A) failure of the frame due to the failure of the internal column.
Figure 16B:
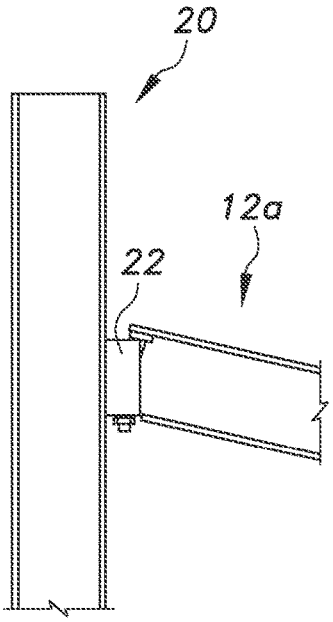
Figure 16C:
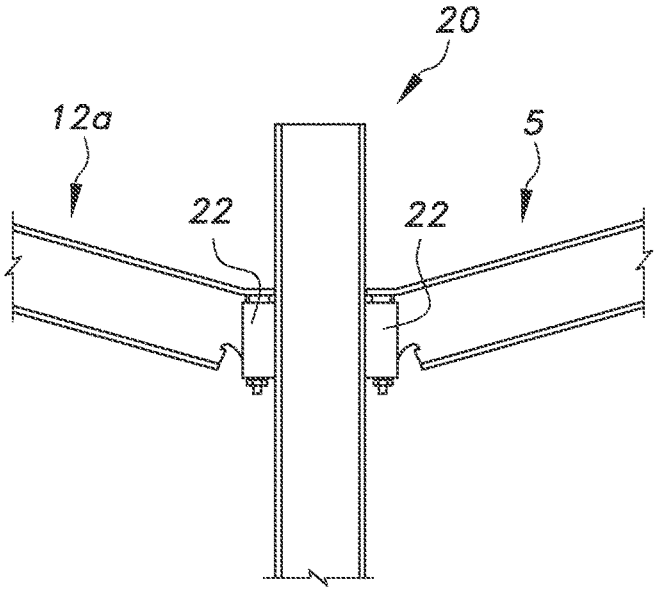

Conventional shear beam-column connections 10 have poor resistance against progressive collapse because bolts used for transfer of shear force from beam to column are also used for resisting progressive collapse (FIGS. 15A-15C). On the other hand, the present shear beam-column connection 10 transfers beam gravity loads to the column through the bolt head 34, whereas progressive collapse is resisted by resistance of the slot of the wedge slot block 22 against the tapered bolt 14 coming out of or deforming the slot 38 (FIG. 16A-16C). The magnitude of resistance against progressive collapse offered by the present shear beam-column connection depends upon the shape, size and material choices.

A simulation was performed to demonstrate the performance of conventional beam-column connections and embodiments of the present shear beam-column connections in situations of progressive collapse. Numerical simulations were performed using finite element analysis software to model progressive collapse of model 2D frames. A representative portion of a frame was used for the purpose of detailed investigation of the performance of the proposed connection. The progressive collapse is the propagation of an initial local failure from one part to the adjoining parts and eventually the collapse of the entire building or large part of it. The initial local failure may be caused due to the failure of column(s) under the exposure to the extreme load cases such as blast loads, vehicle crash, or earthquake. The behavior of the connections under the action of normal loads (i.e., dead, live, and lateral loads) is also reflected in the progressive collapse resistance of the proposed connection because the beam-column connections get tested for negative as well as positive moments in the progressive collapse analysis.

Figure 17:
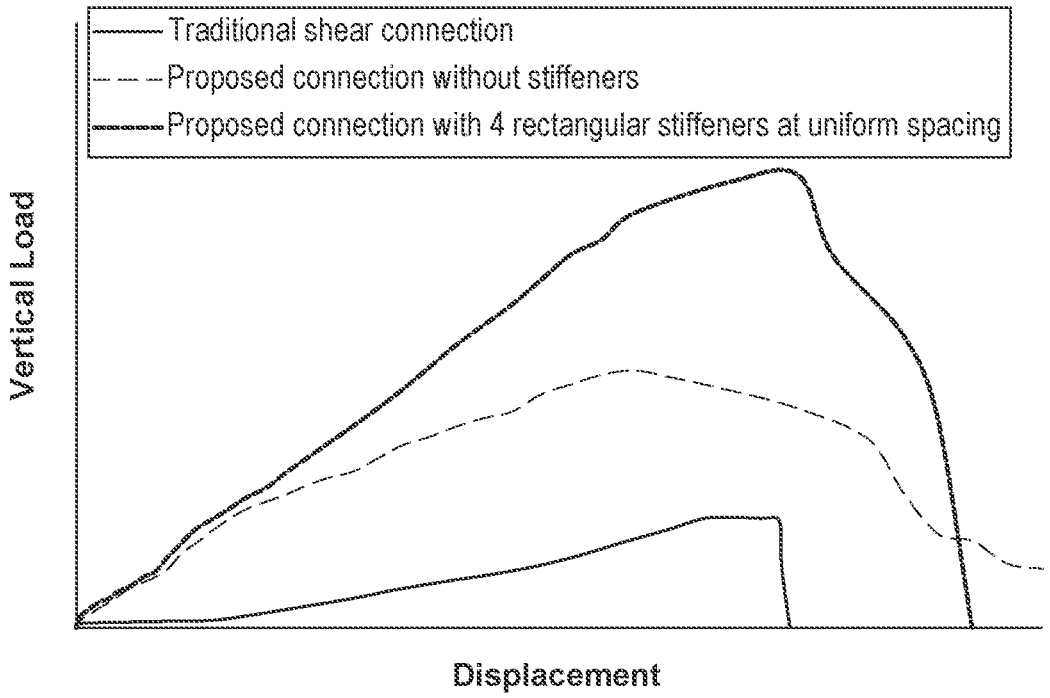
FIG. 17 is a graph showing load-displacement for embodiments of the present shear beam-column connections (with and without stiffeners) and traditional shear beam-column connection during progressive collapse.

FIG. 17 shows a comparison of the load-displacement pattern for simulated frames having traditional shear beam-column connection (as shown in FIGS. 15A-15C) and the present shear beam-column connection (as shown in FIG. 16) obtained from progressive collapse simulation. FIG. 17 reveals that the present shear beam-column connection offers substantially higher resistance against progressive collapse. FIG. 17 also includes the results of analysis of the present connection with rectangular stiffeners 50 at uniform spacing (FIG. 14B), which indicates that the use of stiffeners substantially enhances resistance to the progressive collapse. Further improvement in progressive collapse resistance can be achieved through the use of stiffeners 50 with close spacing near the top and bottom portions and/or increasing the number of stiffeners in total. The enhancement in the progressive collapse resistance by the present shear beam-column connection is due to: (i) the absence of bolt holes in the web, (ii) higher moment resisting capacity and higher rotation capacity of the connection, and (iii) transfer of axial force through the entire beam web, which is only through the bolts in conventional shear connections. The improved progressive collapse resistance of the present shear beam-column connection also indicates improved behavior under the action of normal loads (i.e., dead, live, and lateral loads) because the beam-column connections are tested for negative and positive moments in progressive collapse analysis.

The tapered bolts 14 of the present shear beam-column connection can have, in different embodiments, circular or non-circular elliptical cross-section, as shown in FIG. 18. The lower threaded portion of the tapered bolt 14 is cylindrical for tightening the nut 44. The corresponding wedge slot block is also shown in FIG. 19. The wedge slot block 22 can have a cavity in the shape of an inverted elliptical conical frustum, which matches the shape of the shank of the tapered bolt of elliptical cross-section, again with slightly larger dimensions. The back face of the wedge slot block 22 can be welded to the column flange.

These proposed connections are simple and easy to construct. The connections may be made using commercially available steel tapered bolts and wedge slot blocks. The connection does not require very precise construction and fabrication tolerances. The shear beam-column connections and material choices of the elements therein are not necessarily limited, but in an embodiment are all steel, part of a steel frame for a building, for example.

It is to be understood that the shear beam-column connection is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A beam-column connection structure, the beam-column connection structure comprising:

a first beam having a substantially rectangular web, an upper beam flange extending normal to a top edge of the web, and a lower beam flange extending normal to a first portion of a bottom edge of the web, one end of the upper beam flange defining an overhang portion that extends beyond an edge of the lower beam flange and a side edge of the web defining a ledge portion;

a first tapered bolt having a bolt head secured to a lower surface of the overhang portion of the upper beam flange, a shank having a non-threaded upper portion and a threaded end portion, the non-threaded portion of the shank being fixedly secured to the ledge portion;

a first wedge slot block including a cavity defined therethrough configured to receive the non-threaded portion of the shank, and a slot extending along a side of the block, the slot being contiguous with the cavity and configured to receive the ledge portion; and a column having a first column flange, a second column flange, and a column web extending between the first column flange and the second column flange, the first column flange and the second column flange extending normal to the column web, the first wedge slot block being secured to the first column flange.

2. The beam-column connection structure according to claim 1, further comprising a second beam having a substantially rectangular web, an upper beam flange extending normal to a top edge of the web, and a lower beam flange extending normal to a first portion of bottom edge of the web, one end of the upper beam flange defining an overhang that extends beyond an edge of the lower beam flange and a second portion of the bottom edge of the web defining a free end;

a second tapered bolt having a bolt head secured to a lower surface of the overhanging upper beam flange, a shank having a non-threaded upper portion and a threaded end portion, the non-threaded portion of the shank being secured to the web;

a second wedge slot block including a cavity defined therethrough configured to receive the non-threaded portion of the shank, and a slot extending along a side of the block, the slot being contiguous with the cavity and configured to receive the free web end, the second wedge slot block being secured to the second column flange.

3. The beam-column connection structure according to claim 1, wherein a diameter of an upper portion of the shank is greater than a diameter of a lower portion of the shank, and a diameter of an upper portion of the cavity is greater than a diameter of a lower portion of the cavity.

4. The beam-column connection structure according to claim 1, wherein a diameter of the upper portion of the cavity is greater than a diameter of the upper portion of the shank.

5. The beam-column connection structure according to claim 1, further comprising a nut releasably secured to the threaded end of the shank.

6. The beam-column connection structure according to claim 1, wherein a widest diameter of the cavity is greater than a widest diameter of the first shank.

7. The beam-column connection structure according to claim 1, wherein the non-threaded portion of the shank is fixedly secured to the web by welding.

8. The beam-column connection structure according to claim 1, further comprising at least one stiffener connected to the block and the first column.

9. The beam-column connection structure according to claim 8, wherein said at least one stiffener comprises a plurality of stiffeners.

10. The beam-column connection structure according to claim 1, wherein a lower surface of the upper beam flange includes a groove defined therein for receiving the bolt head.

11. The beam-column connection structure according to claim 10, wherein the bolt head is secured to the groove by welding.

* * * * *